US012134937B2

(12) United States Patent
Merzhäuser

(10) Patent No.: US 12,134,937 B2
(45) Date of Patent: Nov. 5, 2024

(54) IMPACT PISTON DEVICE FOR A IMPACT DRILL DRIVE

(71) Applicant: EURODRILL GmbH, Drolshagen (DE)

(72) Inventor: Markus Merzhäuser, Drolshagen (DE)

(73) Assignee: EURODRILL GmbH, Drolshagen (DE)

( * ) Notice: Subject to any disclaimer, the term of this patent is extended or adjusted under 35 U.S.C. 154(b) by 0 days.

(21) Appl. No.: 18/297,756

(22) Filed: Apr. 10, 2023

(65) Prior Publication Data

US 2023/0358099 A1 Nov. 9, 2023

(30) Foreign Application Priority Data

May 4, 2022 (EP) ..... 22 171 590

(51) Int. Cl.
*E21B 1/26* (2006.01)

(52) U.S. Cl.
CPC ..... *E21B 1/26* (2020.05)

(58) Field of Classification Search
CPC ... E21B 1/26; E21B 4/14; E21B 7/022; B25D 9/26; B25D 9/16; B25D 9/12; F15B 15/1447; F15B 13/0401; F15B 2211/7055
See application file for complete search history.

(56) References Cited

U.S. PATENT DOCUMENTS 4,006,783 A * 2/1977 Granholm ..... F03C 1/007 91/170 R
6,959,967 B1 * 11/2005 Prokop ..... B25D 9/26 173/206
2021/0206224 A1 * 7/2021 Repela ..... B60G 17/0525

FOREIGN PATENT DOCUMENTS

DE 26 35 191 C3 7/1981
JP S61-19574 A 1/1986

OTHER PUBLICATIONS

The extended European search report issued by the European Patent Office on Oct. 4, 2022, which corresponds to European Patent Application No. 22171590.7-1002.

* cited by examiner

*Primary Examiner* — Nathaniel C Chukwurah
(74) *Attorney, Agent, or Firm* — Studebaker & Brackett PC

(57) ABSTRACT

The invention relates to an impact piston device for an impact drill drive, comprising an impact piston, which is movably mounted in a piston housing so as to be reversible between a front striking position and a rear retracted position, the impact piston having at least one front pressurizing surface and at least one rear pressurizing surface, at least one front pressure chamber and a rear pressure chamber being formed together with the piston housing, a hydraulic fluid feed, a hydraulic fluid drain, a first control device, by which at least the rear pressure chamber for effecting the reversing movement of the impact piston is connected alternately to the hydraulic fluid feed and the hydraulic fluid drain, and a second control device, with which at least one stroke path of the impact piston within the piston housing can be adjusted, the first control device having an actuatable first control valve and the second control device having an actuatable second control valve. According to the invention, it is provided that the first control valve and second control valve are arranged in a common valve housing.

9 Claims, 3 Drawing Sheets

IMPACT PISTON DEVICE FOR A IMPACT DRILL DRIVE

Figure 1:
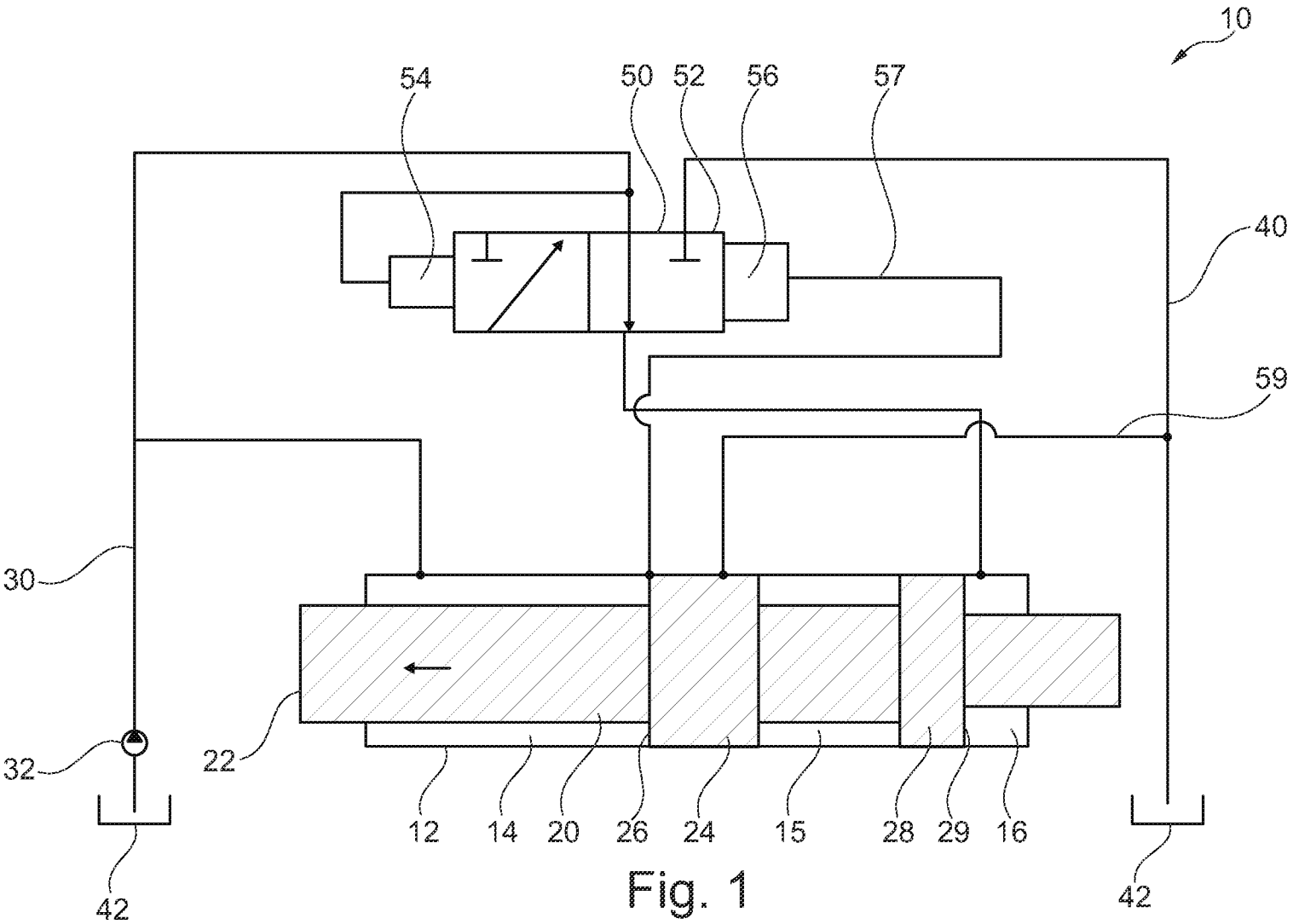

The invention relates to an impact piston device for a impact drill drive, comprising an impact piston, which is movably mounted in a piston housing so as to be reversible between a front striking position and a rear retracted position, the impact piston having at least one front pressurizing surface and at least one rear pressurizing surface, at least one front pressure chamber and a rear pressure chamber being formed together with the piston housing, a hydraulic fluid feed, a hydraulic fluid drain, a first control device, via which at least the rear pressure chamber for effecting a reversing movement of the impact piston is connected alternately to the hydraulic fluid feed and the hydraulic fluid drain, and a second control device, with which at least one stroke path of the impact piston within the piston housing can be adjusted, the first control device having an actuatable first control valve and the second control device having an actuatable second control valve, according to the preamble of claim 1.

Such impact piston devices are used in particular in impact drill drives that are needed for earth and rock drilling machines, especially for so-called anchor drills. With an impact piston, an additional impacting movement can thus be applied to a rotatably driven drilling tool. Good drilling progress is achieved in this way, especially in hard materials, particularly when drilling stone material or in rock.

An generic impact piston device for a impact drill drive can be found for example in DE 26 35 191 C3.

This known impact piston device comprises a piston or hammer, which is mounted in a piston housing so as to be axially movable between a front pressure chamber and a rear pressure chamber. One of the two pressure chambers is continuously hydraulically preloaded with a hydraulic fluid via a first control device comprising a control valve. The other pressure chamber is alternately supplied with and drained of pressurized fluid by the first control device comprising the control valve. When fluid is supplied to this pressure chamber, the larger pressurizing surface at the impact piston effects an axial shift against the preload direction. A corresponding countermovement occurs when the pressure chamber is drained or vented.

To change the stroke length of the impact piston, a second control device comprising a control valve is provided, arranged separately from the first control device. Different stroke lengths of the impact piston or hammer can be set by opening and closing various channels that are provided and by way of mutually axially offset ring grooves to the piston housing.

The adjustments are associated with a certain time lag.

The object of the invention is based to provide an impact piston device which has a particularly efficient response characteristic.

The object is achieved in accordance with the invention by an impact piston device having the features of claim 1. Preferred embodiments of the invention are indicated in the dependent claims.

The inventive impact piston device for an impact drill drive is characterized in that the first control valve and second control valve are arranged in a common valve housing.

An underlying concept of the invention consists in combining the two control valves of the two control devices in one valve housing. This results in principle in very short line lengths and channels for the hydraulic liquid. In addition, the lines can be fixed in the housing, thus avoiding or minimizing the risk of leakage and damage to loose pipelines or hose lines, for example. The shortening of the lines and the resulting improvement in flow together with a corresponding reduction in the volume of liquid in the lines improves a response characteristic of the control arrangement with the two control valves. This results in a faster and more efficient actuation and adjustment of the impact piston during operation, where is also given a more compact and robust design. A preferred embodiment of the invention exists in that the valve housing comprises a valve block in which the fluid lines and the valve receptacles are formed, in particular milled. This gives rise to a particularly robust valve arrangement and control arrangement in a preferably metal valve block. This valve block is particularly resistant to vibration and mechanical influences from outside.

The lines are preferably incorporated, in particular milled, in the valve block as recesses. An advantageous development of the invention is that a cover plate is provided, with which the valve block containing the valve lines and the valve receptacles is closed. The cover plate is placed on the valve block by way of an appropriate seal and is preferably screwed to the valve block in a liquid-tight manner. This preferably two-part housing design firstly allows for a particularly simple manufacture of a robust valve block and secondly permits easy maintenance, since only the cover plate or upper housing half needs to be removed from the valve block or a lower housing half.

In a particularly expedient embodiment of the invention exists in that a port for the hydraulic fluid feed, a port for the hydraulic fluid drain and a connection port for a line connection to the piston housing are arranged on the valve housing. In particular, only these three, four or five ports can be provided on the housing, thus can be achieved a particularly robust device.

In principle, any suitable and necessary control valve can be provided and arranged inside the valve block. It is particularly preferable here for the first control valve to be designed as an actuatable 3/2-way valve. The control valve can preferably be actuated by way of an electrically operable, in particular an electromagnetic, operating element. The control valve can have in particular an axially displaceable control piston, which is displaceable between its actuating positions by way of an electromagnet.

In a particularly expedient embodiment of the invention exist in that the first control valve connects the piston housing, in particular the rear pressure chamber, alternately to the hydraulic feed and the hydraulic drain. In particular, a front pressure chamber, which is arranged closer to the striking surface of the piston, is continuously supplied with a constant hydraulic fluid pressure. Through the alternating connection of the rear pressure chamber via the first control valve to the hydraulic feed on the one hand and the hydraulic fluid drain on the other hand, a reversing movement of the impact piston can be brought about by way of an appropriate design of annular operating surfaces on the impact piston.

When the hydraulic feed is switched on, due to a correspondingly larger operating surface of the impact piston facing the rear pressure chamber, a force can be exerted on the impact piston in the region of the rear pressure chamber that is larger by a defined amount than the force that is exerted in the front pressure chamber on a corresponding smaller operating surface of the impact piston. The hydraulic feed can be designed in this case with a ring groove on the impact piston and/or the piston housing, such that when the impact piston is in a specific position, pressurized fluid can flow out of the front pressure chamber into the rear pressure chamber via a pressure channel that is formed, thus allowing for a change to the striking operation. The resulting equal pressure in the two pressure chambers leads to this fact that, due to the differing sizes of the operating surfaces, a larger force is exerted by the pressurized fluid on the impact piston in the rear pressure chamber, for example and pushing it forward in a defined manner to execute a strike.

According to a further embodiment of the invention, it is preferable for the actuatable second control valve to be designed as a 3/2-way valve or as a 4/3-way valve. Similarly to the first control valve, the second control valve can be electrically operated by way of an electromagnetic operating element. In particular, the control valve can have an axially shiftable control piston, which is shiftable between its actuating positions by way of an electromagnet. Alternatively, the control valves can also be actuated via pressure channels.

A particularly expedient embodiment of the impact piston device according to the invention exists in that an outlet of the second control valve is connected to a control line for actuating the first control valve. A direct control line between the two control valves can thus be provided. A change in pressure can bring about a control operation in this case.

According to a further variant of the invention, it is provided that the inlets of the second control valve are each connected by a line to an annulus space in the piston housing. The annulus space in the piston housing can be formed in this case by a ring groove on the impact piston itself and/or in the inner wall of the piston housing. In particular, a plurality of axially to each other spaced-apart annulus spaces are provided for adjusting a stroke length of the impact piston. Depending on the coupling of the annulus spaces, it is thus possible to determine in which axial position of the impact piston a pressure channel and a pressure buildup in the rear pressure chamber is achieved, allowing a forward striking movement of the impact piston to be initiated.

According to a further embodiment of the inventive impact piston device it is preferably that a control port for actuating the second control valve is provided on the valve housing. In this way, the second control valve can be actuated directly via a control port.

The invention comprises a impact drill drive having at least one drill drive, wherein an impact piston device according to the invention is provided. The drill drive is thereby designed for rotationally driving a drilling tool. An axial striking movement can be exerted on the drilling tool by the impact piston device constantly or at certain times.

In particular, according to the invention, the impact drill drive can be arranged on a carriage or mast of an earth or rock drilling machine. In particular, the earth or rock drilling machine can be used for anchor drilling in specialist civil engineering.

Figure 2:
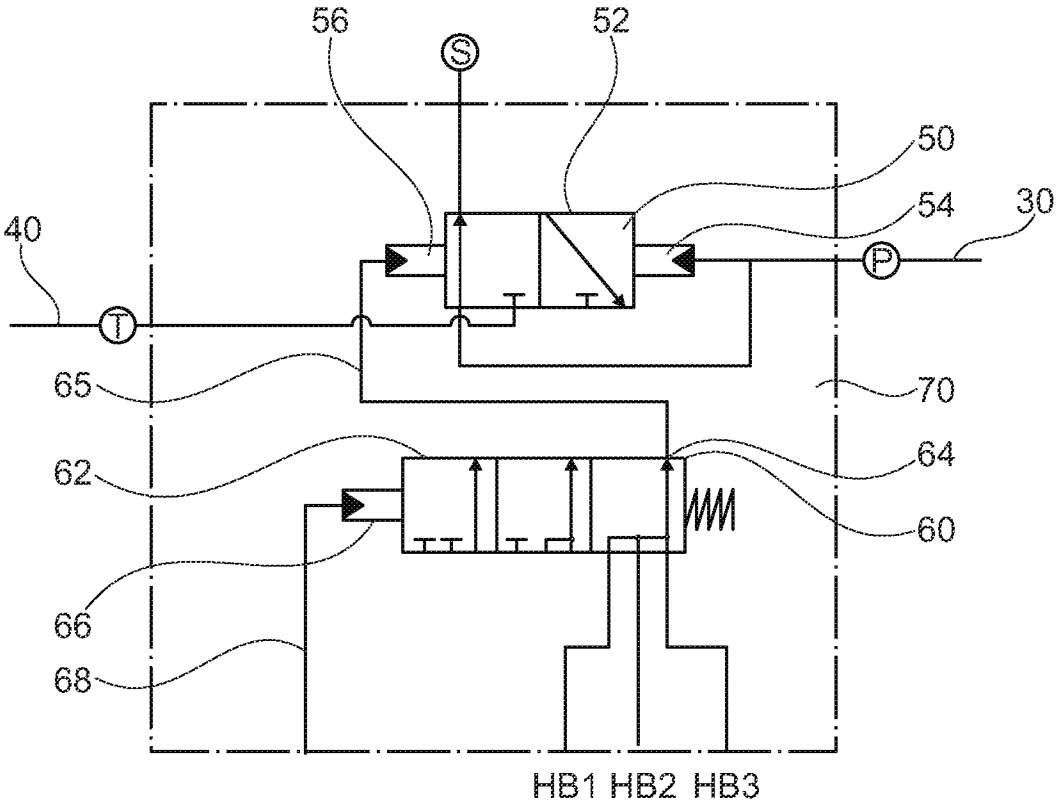
Figure 3:
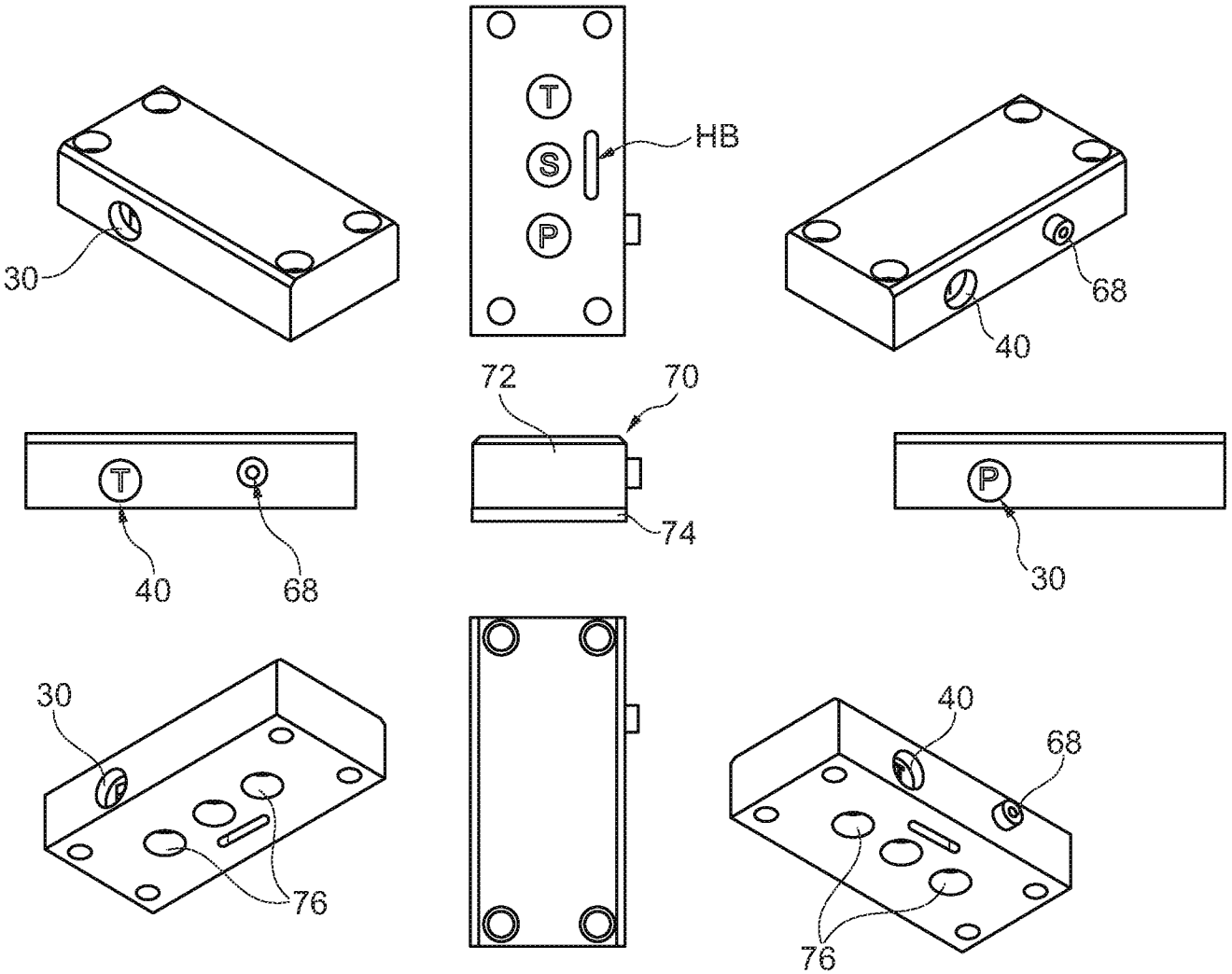

The invention is described in more detail below by reference to a preferred exemplary embodiment, which is illustrated schematically in the figures. In the figures show:

FIG. 1 a schematic circuit arrangement for the impact piston device according to the invention;

FIG. 2 a hydraulic circuit diagram for the impact piston device according to the invention; and FIG. 3 a block-type valve housing provided for the invention in various side views and various perspective views.

To illustrate the operating mode of an impact piston device 10 according to the invention, a first circuit arrangement with a first control device 50, but without the second control device according to the invention, is shown in FIG. 1. In a piston housing 12, which is indicated only schematically, a shaft-shaped impact piston 20 is movably mounted so as to be reversible. The impact piston 20 projects out of the piston housing 12 with a front striking side 22, wherein the striking side 22 can impinge in a striking manner on, for example, a drill drive shaft (not shown).

A front first shoulder 24 and at least one further rear second shoulder 28 are formed on the impact piston 20 in a generally known manner. The larger-diameter shoulders 24, 28 are spaced axially apart from each other, an annulus space 15 having a smaller diameter being formed in each case between two adjacent shoulders 24, 28. In the piston housing 12 having a cylindrical receiving chamber, a first front pressure chamber 14 is delimited by the first shoulder 24, a front pressurizing surface 26 directed towards the front pressure chamber 14 being formed on the first shoulder 24.

In the receiving chamber of the piston housing 12, a rear pressure chamber 16 is formed behind the second shoulder 28, a rear pressurizing surface 29 directed towards the rear pressure chamber 16 being formed on the rear second shoulder 28. Essential to the operating mode of this impact piston device 10 is here that the rear pressurizing surface 29 is larger than the front pressurizing surface 26, as is also clearly shown in FIG. 1.

For the reversing movement of the impact piston 20, which is shown in FIG. 1 in a retracted position in the piston housing 12, provision is made for a hydraulic feed 30 with lines. Hydraulic liquid is drawn in from a tank 42 by a hydraulic pump 32 and introduced under pressure into the hydraulic feed 30. The front pressure chamber 14 is continuously supplied with the pressurized hydraulic liquid via a first branch to this. The action of the hydraulic liquid in the front pressure chamber 14 on the front pressurizing surface 26 pushes the impact piston 20 backwards into its retracted position shown in FIG. 1.

Furthermore, the hydraulic feed 30 runs with a line to a first control device 50 comprising a first control valve 52, which comprises three ports and can assume two valve positions. The first control valve 52 is thus a 3/2-way valve.

In the first setting position shown in FIG. 1, hydraulic liquid is directed from the hydraulic feed 30 to the rear pressure chamber 16 in the piston housing 12. By reason of the larger surface of the rear pressurizing surface 29 on the second shoulder 28, a force is exerted on the impact piston 20 in the direction of the striking side 22 which is greater than an opposing force exerted by the pressure fluid in the front pressure chamber 14 on the front pressurizing surface 26. In this position of the first control valve 52, the impact piston 20 is thus moved forwards out of the piston housing 12 to execute a striking movement. A valve position can be detected via a first control port 54 on the actuatable first control valve 52, dependent on the pressure in the hydraulic feed 30 ahead of the first control valve 52. A pressure in a control line 57, which leads into the piston housing 12 at the edge of the front pressure chamber 14 leading towards the first shoulder 24, can be detected via a second control port 56 by way of a control line 57.

By displacing the impact piston 20 forwards towards the striking side 22, the control line 57 is cut off from the front pressure chamber 14. A further movement of the impact piston 20 in the direction of the arrow shown in FIG. 1 connects the annulus space 15 to a venting line 59, which likewise leads into the piston housing 12. When the impact piston 20 is in a corresponding position, the annulus space 15 can vent via the venting line 59 towards a hydraulic drain 40 and hence to the tank 42. The annulus space 15 is thus unpressurized or has in any case a reduced pressure. A further shifting of the impact piston 20 in the arrow direction establishes a line connection between the vented annulus space 15 and the control line 57, such that a corresponding pressure reduction is established in the control line 57. In this way, the first control valve 52 can be switched over by the second control port 56 of the first control device 50.

This switch-over brings the control valve 52 into the second valve position, in which pressure fluid is no longer directed through the hydraulic feed 30 to the piston housing 12 via the first control valve 52. In addition, the connection line to the piston housing 12 is then connected via the first control valve to the hydraulic drain 40 and hence to the tank 42. The rear pressure chamber 16 thus vents to the tank 42 and is depressurized switched, in any case a marked pressure drop is brought about. Therefore, due to the continuous feed of hydraulic fluid through the hydraulic feed 30 via the first branch, the pressure in the front pressure chamber 14 is greater, and thus also the force acting on the impact piston 20 via the front pressurizing surface 26. A backward movement of the impact piston 20 back again into the piston housing 12 and into the retracted position as shown in FIG. 1 is thus initiated.

It results from the arrangement as shown in FIG. 1 that the arrangement of one or more annulus spaces 15 has an influence on the stroke length of the impact piston 20 in the piston housing 12.

Where two or more annulus spaces 15 are arranged at the impact piston 20, the stroke of the impact piston 20 can be influenced and hence adjusted by way of a second control device 60, which is described in relation to FIG. 2.

According to the invention, the first control device 50 and the second control device 60 are arranged in this case in a common valve housing 70, wherein the circuit arrangement is shown schematically in FIG. 2 and explained below.

As shown in relation to FIG. 1, the first control device 50 can have a first control valve 52 with three ports and two valve positions. A line connection to the hydraulic feed 30 is established via a port P, while a line connection to the hydraulic drain 40 and hence to a tank 42 is established via a port T. The first control device 50 is connected by a line to the piston housing 12 of the impact piston 20 via a port S, as described previously in relation to FIG. 1. Corresponding to the previous description relating to FIG. 1, the first control port 54 of the first control device 50 is connected by a line to the hydraulic feed 30.

According to the invention, the second control device 60 comprising the second control valve 62 is also arranged in the same valve housing 70 in which the first control device 50 is arranged.

In the depiction shown in FIG. 2, the second control valve 62 preferably has four ports and three valve positions, thus is a 4/3-way valve. Here, an outlet 64 of the second control valve 62 is connected by way of a pressure control line 65 to the second control port 56 of the first control valve 52. The three spaced-apart annulus spaces of a possible further impact piston 20 with four shoulders are connected, respectively, to the three inlets HB1, HB2 and HB3 of the second control valve 62. Via a control port 66 on the second control valve 62 and via an actuating line 68, a machine operator can choose and trigger, according to a desired stroke length of the impact piston 20 in the piston housing 12, which of the inlets HB1, HB2, HB3 and hence which of the annulus spaces 15 at the impact piston 20 are to be connected to the pressure control line 65 in order to actuate the first control valve 52. According to the arrangement of the three annulus spaces in the present exemplary embodiment, a longer or shorter stroke path of the impact piston 20 in the piston housing 12 is then established.

In principle, fewer or more annulus spaces 15 can also be provided at the impact piston 20, wherein a corresponding adaptation of the second control valve 62 with a corresponding reduction or increase of inlets is then required.

The valve housing 70 provided for the invention, with a box-like valve block 72, which can be closed on one side by way of a cover plate 74, is shown in FIG. 3 in a number of views of different sides. The cover plate 74 is shown here only in the middle side view. Valve receptacles 76 and lines or ducts for forming the first control device 50 and the second control device 60 can be incorporated, in particular milled, into the valve block 72. Overall, a particularly robust circuit arrangement with short line paths is thus achieved. A particularly fast actuation and also switching of stroke lengths can be accomplished in this way.

As can be taken from FIG. 3, a port for the hydraulic feed 30 can be provided on one side of the valve housing 70 and a port for the hydraulic drain 40 and the actuating line 68 can be provided on the opposite side. Corresponding ports for connection to the annulus spaces for the purposes of stroke limitation HB can be arranged on another side.

The invention claimed is:

1. An impact piston device for an impact drill drive, comprising an impact piston, which is movably mounted in a piston housing so as to be reversible between a front striking position and a rear retracted position, the impact piston having at least one front pressurizing surface and at least one rear pressurizing surface, at least one front pressure chamber and a rear pressure chamber being formed together with the piston housing, a hydraulic fluid feed, a hydraulic fluid drain, a first control device, via which at least the rear pressure chamber for effecting the reversing movement of the impact piston is connected alternately to the hydraulic fluid feed and the hydraulic fluid drain, and a second control device, with which at least one stroke path of the impact piston within the piston housing can be adjusted, the first control device having an actuatable first control valve and the second control device having an actuatable second control valve, wherein the first control valve and second control valve are arranged in a common valve housing, the valve housing comprises a valve block in which the fluid lines and the valve receptacles are formed, in particular milled in, and a cover plate is provided, with which the valve block containing the fluid lines and the valve receptacles is closed.

2. The impact piston device according to claim 1, wherein a port for the hydraulic fluid feed, a port for the hydraulic fluid drain and a connection port for a line connection to the piston housing are arranged on the valve housing.

3. The impact piston device according to claim 1, wherein the first control valve is designed as an actuatable 3/2-way valve.

4. The impact piston device according to claim 1, wherein the first control valve connects the piston housing, in particular the rear pressure chamber, alternately to the hydraulic fluid feed and the hydraulic fluid drain.

5. The impact piston device according to claim 1, wherein the actuatable second control valve is designed as a 3/2-way valve or as a 4/3-way valve.

6. The impact piston device according to claim 1, wherein an outlet of the second control valve is connected to a pressure control line for actuating the first control valve.

7. The impact piston device according to claim 1, wherein the inlets of the second control valve are each connected by a line to an annulus space in the piston housing.

8. The impact piston device according to claim 1, wherein a control port for actuating the second control valve is provided on the valve housing.

9. An impact drill drive having at least one drill drive, wherein an impact piston device according to claim 1 is provided.

* * * * *